United States Patent [19]

Knorre et al.

[11] 4,252,637

[45] Feb. 24, 1981

[54] PROCESS FOR THE REPROCESSING OF USED LUBRICATING OILS (II)

[75] Inventors: Helmut Knorre, Seligenstadt; Manfred Langer, Karlstein; Axel Waniorek, Rodenbach, all of Fed. Rep. of Germany

[73] Assignee: Deutsche Gold und Silber-Scheideanstalt vormals Roessler, Frankfurt, Fed. Rep. of Germany

[21] Appl. No.: 31,108

[22] Filed: Apr. 18, 1979

[30] Foreign Application Priority Data

Apr. 27, 1978 [DE] Fed. Rep. of Germany ..... 2818521

[51] Int. Cl.[3] ..... C10M 11/00

[52] U.S. Cl. ..... 208/180; 208/181; 208/183; 208/184

[58] Field of Search ..... 208/179, 181–185, 208/180; 423/DIG. 12

[56] References Cited

U.S. PATENT DOCUMENTS

| | | | |
|---|---|---|---|
| 1,698,257 | 1/1929 | Cherry | 208/179 |
| 1,777,722 | 10/1930 | Grisbaum | 208/179 |
| 3,304,255 | 2/1967 | Katsuta | 208/179 |
| 3,625,881 | 12/1971 | Chambers | 208/179 |
| 4,097,369 | 6/1978 | Ebel | 208/181 |

FOREIGN PATENT DOCUMENTS

| | | | |
|---|---|---|---|
| 2259895 | 10/1975 | France | 208/183 |

OTHER PUBLICATIONS

Voskresenskaya, Ed. *Handbook of Solid–Liquid Equilibria in Systems of Anhydrous Inorganic Salts,* vol. I, Israel Program for Scientific Translations, Jerusalem, (1970), pp. 447–449.

*Primary Examiner*—Brian E. Hearn

*Attorney, Agent, or Firm*—Beveridge, DeGrandi, Kline & Lunsford

[57] ABSTRACT

A process for the reprocessing of used lubricating oil wherein said oils are treated with a mixture of potassium hydroxide and sodium hydroxide.

5 Claims, No Drawings

PROCESS FOR THE REPROCESSING OF USED LUBRICATING OILS (II)

BACKGROUND OF THE INVENTION

The invention relates to a method for reprocessing of used lubricating oils by alkaline treatment of the oil or of its raffinate at elevated temperature as well as reprocessing by one or several of the following steps; i.e. acidification, distillation, hydrogenation, bleaching clay filtration.

According to known methods for reprocessing used lubricating oils by alkaline treatment, and the successive chemical and/or physical processing steps, the impurities present in a heterogenously dispersed or dissolved state are removed. The alkaline treatment has for its purpose, the separation of as large a part of the impurities present in the used oil as possible in advance, so that the chemical and/or physical methods of purification may be carried out as smoothly as possible and with a small expenditure in apparatus, and in a material-saving manner. Acidification, hydrogenation or distillation, filtration with bleaching clay or a combination of these measures come into consideration as chemical or physical types of processing.

It has been known to treat used oil with caustic chemicals in order to achieve thereby the separation of the impurities required for an effective purification. The alkaline treatment has above all the advantage over an acid treatment according to the sulfuric acid process in that the waste materials are less harmful to the environment than is the "acid tar" developed by the sulfuric acid process, and in that because of resides in the quantities of the ash contained in the used oil and of the chemicals added to the used oil.

A distillation is advantageous as a final purification step since the filtration will encounter difficulties without previous acidification or expensive washing out. The also possible hydrogenation is eliminated generally because of costs.

The reprocessing methods for used oil, described in the literature heretofore and operating with an alkaline treatment step, still possess an additional, essential disadvantage, which up to now formed an obstacle for its introduction into practice. In case of the known reprocessing methods with individual alkaline-reacting chemicals, such as caustic soda, caustic potash, soda, sodium silicate or calcium hydroxide or their aqueous solutions, only an unsatisfactory separation of the impurities was achieved. Moreover, partly very long processing times were needed, which are prohibitive especially for an economic operation of a continuously operating installation.

However, whenever one puts up with an insufficient preliminary purification, only either qualitatively low grade secondary raffinates were obtained, or else one was forced into increased expenditure in the final purification step for example, with a fractionated distillation. Since impurities in the used oil reduce the cracking temperatures of the oil fractions, one was forced in case of incomplete preliminary purification to distill at lower temperatures, for example, in case of most used oils at temperatures below 300° C. Therefore, the distillations could only be carried out at a high vacuum in very expensive apparatus.

According to U.S. Pat. No. 3,625,881 the proposal was made, to precede the fractionated distillation of used oils by a simultaneous treatment with easily boiling hydrocarbons and an alkali metal hydroxide solution. This was to produce an easier distillability and qualitatively improved products. In this case, 0.2 to 2.0% by weight of an alkali metal hydroxide in at least 40% aqueous solution are added to the dried oil at temperatures between 93° and 149° C. However, it turned out in practice, that the described measures were not sufficient in order to bring about the separation of a sufficiently large part of the impurities and to achieve a lubrication oil, qualitatively of equal value as a primary raffinate. Only in case of used oils with a low degree of contamination does this method appear usable.

U.S. Pat. No. 3,304,255 describes a method for the continuous reprocessing of lubricating oil from diesel engines of ships during their operation. In the described method, a partial stream of the lubricating oil is washed with a diluted alkali metal hydroxide solution, as a result of which there is achieved an enlargement of the particles and an easier flocculation of the impurities. In detail, one operates with the addition of 0.6% sodium hydroxide in the form of, preferably, 10%, maximally 20% solution. The processing time amounts to about 15 minutes at a temperature below 100° C. This process too, may not be applied successfully to the used oils obtained in practice, which are often further strongly contaminated with additional oily waste products.

According to the Japanese patent application 73-49.801, used oil may be pre-purified prior to hydrogenation by a simple treatment with 2 vol. % of a 20% aqueous NaOH at 25°-80° C. and settling times of about 36 hours. However, it turned out, that this type of preliminary purification is not sufficient for the subsequent final purification by distillation. Moreover, in case of the used oils customarily obtained, no useful phase-separation will be achieved, so that the execution of this process encounters difficulties in practice.

Therefore, it was necessary to search for a process which has the advantage of the alkaline reprocessing method, is applicable universally to the broad spectrum of used oils collected in practice and not only applicable to used lubricating oils with a low degree of contamination, and which at the same time leads to raffinates, which qualitatively are the equals to the original raffinates without a requirement for expensive apparatus which would prohibit the technical realization of such a process.

SUMMARY OF THE INVENTION

It had now been found that used lubricating oils, as a result of alkaline treatment of the oil or its crude raffinate at elevated temperature, or reprocessing by one or several of the steps: acidification, distillation, hydrogenation, bleaching clay filtration and while avoiding the disadvantages inherent in the known processes, may be reprocessed to qualitatively very good secondary raffinates, whenever the oil is treated with 0.5 to 10% by weight, preferably 1.5 to 5% by weight of a mixture of 20 to 70 parts by weight of potassium hydroxide and 80 to 30 parts by weight sodium hydroxide, at temperatures above 200° C.

The alkaline treatment according to the invention makes possible the flocculation of the largest part of the impurities in the used oil, in a very short time. An additional, considerable advantage of this treatment lies in the fact that when using distillative reprocessing, one may even omit a separation of the flocculated impurities prior to the distillation. By comparison, distillation following one of the prior known alkaline methods of treatment is greatly impeded by plugging up and poor flowing off of the highly viscous distillation residue.

In case of the used oil treatment of the invention with a KOH/NaOH mixture, the mixing ratio, quantities of additions as well as the reaction conditions are variable within the limits stated. The caustic alkalies may be added to the used oil in a solid or dissolved form.

The alkali metal hydroxide mixture must consist at least of 20% by weight of KOH, because only this proportion of KOH will result in a favorable viscosity of the NaOH/KOH mixture in the temperature range used in the process. A proportion of above 70% by weight KOH is not generally required; in many cases it will be sufficient to use no more than about 50% by weight in the mix with NaOH, which is an advantage, considering the higher price of the KOH.

The quantities of additives are governed largely by the nature of the used oil. The amounts lie between 0.5 and 10% by weight of the alkaline metal hydroxide mixture, related to the weight of the used oil that is processed. In case of most used oils, a maximum of 5% by weight is sufficient, only rarely will one get along with less than 1.5% as a quantity of addition.

The treatment temperature must be at least at 200° C., in order to arrive at as short as possible reaction times, which is favorable for a continuous operation in a closed installation. It is advantageous to use treatment temperatures above 300° C.; at the same time, processing times below one hour may suffice. According to a particularly advantageous embodiment of the process of the invention, the treatment temperatures are above 340° C. The treatment temperatures should not exceed 500° C., not even momentarily, in order to keep the cracking low. In case of the known processes of the prior art not operating with a mixture of various alkali metal hydroxides, even treatment temperatures of around 300° C. would cause strong cracking.

The alkali metal hydroxide mixture may be added to the used oil either in a solid or dissolved form. Small quantities of water do not disturb the treatment and subsequent continued processing by distillation, because in that case, normally one operates with strip-steam anyway in order to lower the boiling point. It is advantageous to use the two alkali metal hydroxides in the form of concentrated solutions in water or alcohol of at least 20% by weight of solid substance content.

The separation of the sludge, which is formed during the alkali metal hydroxide treatment, may be accomplished by allowing it to settle for several hours and by decanting, whereby depending on the nature of the used oil and the conditions of treatment, 10–25% by weight related to the weight of the used oil that is processed, as well as 80–90% by weight of a well pre-purified oil with very little residual alkalinity are obtained. One will achieve very short settling times as well as an increased concentration by means of a decanting centrifuge. The excess prepurified oil is then distilled, whereby an industrial vacuum suffices for the distillation, because the decomposition speed of the oil is greatly reduced by the pre-purification according to the invention. The distillation material in this case, may be heated to temperatures up to 480° C.

Re-raffinates of particularly very good quality are obtained, whenever one undertakes the treatment with the caustic alkali mixture following a crude refining of the dried oil with finely dispersed metallic sodium, whereby the potassium hydroxide-sodium hydroxide mixture is produced by addition of aqueous or alcoholic KOH solution to the oil, containing residual metallic sodium.

Another embodiment of the invention provides for the sludge, which settles after the treatment of the oil with the alkali metal hydroxide mixture, and the remaining treatment product is subjected to a refining with concentrated sulfuric acid and subsequent bleaching clay filtration. At the same time, only 1 to 2% by weight $H_2SO_4$ are needed instead of 8 to 15% by weight $H_2SO_4$, as required in case of the classic acid tar process, which leads to a correspondingly lower acid tar yield of 2 to 4% by weight.

The process of the invention will make it possible to distill oil, treated with the KOH-NaOH mixture, directly, i.e., without previous separation of the sludge formed, because at the actual distillation temperatures, the mixtures of potassium and sodium hydroxide are very fluid. Therefore, there will neither be any baking-s-on or pluggings-up; even a highly concentrated sump will run off without a problem from the columns. According to this variation of the invention, the alkali metal hydroxide mixture is added to the oil and the distillation is accomplished in the presence of this mixture.

The sludge which settles during the treatment of the oil with the alkali metal hydroxide mixture and/or the distillation sump may be freed of the volatile components and to obtain the remaining parts of the lubricating oil, by subjecting them to a thermal treatment at temperatures between 400° and 1000° C. The liquid parts, obtained thereby, may again be added to the untreated used oil or its crude raffinate. The gaseous portions obtained may serve for firing the apparatus for the thermal treatment described.

DETAILS OF THE INVENTION

The invention will be explained on the basis of the following examples:

The "used oils" processed were always subjected to a drying process by thermal treatment prior to the processing. Thus, at temperatures between 100° and 200° C. and under standard pressure, the oils are freed of water, easily boiling benzene fractions as well as the chlorohydrocarbons always contained in actual used oils.

EXAMPLE 1

For the experiments, inter alia, two used oils dried as in practice were used, which were characterized by the following analyzed values:

| | Used Oil I | Used Oil II |
|---|---|---|
| Water content | 0.20 | 0.15 |
| Ash | 0.9 | 0.7 |
| Halogen (As Cl) | 0.25 | 0.32 |
| Sulfur | 0.95 | 1.0 |
| C | 85.1 | 84.5 |
| H | 14.9 | 13.2 |
| N | 0.18 | 0.15 |
| Bromine number | 32 | 29 |
| mean molecular weight | 370 | 358 |

Heavy metals used oil I:
Pb 1080, Ca 1328, Al 27, Mg 198, Fe 163, Mn 6.8, Ni 18 Cr 8, Mo 13.5, Si 12.6 Zn 810, Na 133, Cu 36 ppm
Heavy metals used oil II:
Pb 1600, Ca 700, Al 18, Mg 120, Fe 151, Mn 5, Ni 1.4, Cr 5, Mo 7, Si 81, Zn 48, Na 87, Cu 36 ppm

EXAMPLE 2

Always about 1600 g. of the dry used oil I are heated with different additive-quantities of a mixture of 50% by weight KOH and 50% by weight NaOH. After cooling down to 150° C. the supernatant oil was decanted off, the sludge remaining over was weighed out. With the method of operation according to the invention, one will achieve a good coagulation of the impurities and thus a good pre-purification. Whenever one operates at too low a temperature (Experiment 12) or with NaOH only (Experiment 13) no usable pre-purification will be achieved.

| Experim. No. | Weighed sample (g) Used Oil II | KOH 50% | NaOH 50% | Treatment temperature (°C.) | Duration of treatment (min's) |
|---|---|---|---|---|---|
| 1 | 1708 | 51.2 | 51.2 | 360 | 5 |
| 2 | 1620 | 64.8 | 64.8 | 360 | 5 |
| 3 | 1620 | 80.8 | 80.2 | 360 | 5 |
| 4 | 1632 | 97.9 | 97.9 | 360 | 5 |
| 5 | 1600 | 160.0 | 160.0 | 360 | 5 |
| 6 | 1600 | 57.6 | 134 | 360 | 10 |
| 7 | 1584 | 63.4 | 63.4 | 210 | 5 |
| 8 | 1624 | 65.0 | 65.0 | 250 | 5 |
| 9 | 1616 | 64.6 | 64.6 | 300 | 5 |
| 10 | 1604 | 64.2 | 64.2 | 360 | 5 |
| 11 | 1600 | 64.0 | 64.0 | 400 | 5 |
| Counter examples | | | | | |
| 12 | 1600 | 64.0 | 64.0 | 180 | 5 |
| 13 | 1600 | — | 32.0 | 360 | 5 |

-continued

| Counter examples | | | | |
|---|---|---|---|---|
| 12 | 534 | 1082 | 112 | 29.5 |
| 13 | | | no separation | |

* related to dry oil

EXAMPLE 3

5000 g. dry oil (used oil 2) are mixed in a distillation flask with 600 g. 50% alkali metal hydroxide (ratio KOH/NaOH 1:1, corresponding to 3 weight % KOH, 3 weight % NaOH and 6 weight % water related to the dry oil).

The mixture is heated to 360° C. under standard pressure and is left at this temperature for 5 minutes, whereby the water and a small quantity of low boiling hydrocarbons are distilled off.

After cooling to 150° C. the oil is decanted off the sludge.

Subsequently the oil is fractionated in a film evaporator with a jacket surface of 0.05 $m^2$. For this purpose, it is put into the evaporator three times in succession at a dosing-in rate of 1.1 kg/hour at different wall temperatures and different pressures, the rotor of said evaporator runs at about 600 r. p. m. The following fractions are obtained:

| Fraction | Quantity g | % | Distillation temp. Wall °C. | Head °C. | Pressure m bar | Density g/cm² | Viscosity °E. (50° C.) | Color |
|---|---|---|---|---|---|---|---|---|
| 1 (Gas oil) | 610 | 10.9 | 210 | 175 | 5 | 0.84 | — | colorless |
| 2 (spindle oil) | 1277 | 22.8 | 290 | 225 | 5 | — | 2.5 | bright yellow |
| 3 (base oil) | 1820 | 32.5 | 350 | 280 | 1.5 | 0.88 | 6.4 | yellow |
| Sump/oil decanted | 756 | 13.5 | | | | | | black |
| Sump after destill. | 336 | 6.0 | | | | | | |
| Water | 325 | 5.8 | — | — | — | — | — | — |
| First runnings | 476 | 8.5 | — | — | — | — | — | — |
| Total | 5600 | 100 | | | | | | |

| Experim. No. | Weighed out (g) Sludge | Oil | gaseous product, dist. & water | Share of sludge (weight %) * after escape KOH/NaOH | Residual alkalinity in the oil (mVal/g) |
|---|---|---|---|---|---|
| 1 | 273 | 1307 | 230 | 13.0 | 0.06 |
| 2 | 268 | 1352 | 129 | 12.5 | 0.06 |
| 3 | 264 | 1264 | 253 | 11.3 | 0.13 |
| 4 | 291 | 1289 | 247 | 11.8 | 0.06 |
| 5 | 368 | 1192 | 360 | 13.0 | 0.08 |
| 6 | 281 | 1178 | 333 | 11.6 | 0.05 |
| 7 | 315 | 1148 | 138 | 15.9 | not given |
| 8 | 302 | 1286 | 168 | 14.7 | " |
| 9 | 234 | 1313 | 198 | 10.5 | " |
| 10 | 249 | 1247 | 236 | 11.5 | " |
| 11 | 256 | 1056 | 416 | 12.0 | " |

EXAMPLE 4

5000 g. dry oil (used oil II) are mixed in a distillation flask with 600 g. of 50% alkali hydroxide ratio KOH/NaOH 1:1, (corresponding to 3 weight % KOH, 3 weight % NaOH and 6 weight % of water, related to the dry oil).

The mixture is heated to 360° C. under standard pressure and is left for 5 minutes at this temperature, whereby the water and a small quantity of low boiling hydrocarbons are distilled off and are then subjected to a vacuum distillation.

The following fractions are obtained:

| Fraction | Quantity | % | Head Temperature °C. | Sump °C. | Pressure mbar | Viscosity °E. (50° C.) | Density | Color |
|---|---|---|---|---|---|---|---|---|
| 1 (Gas oil) | 823 | 14.7 | 225 | 250 | 20 | — | 0.85 | colorless |
| 2 (spindle oil) | 1674 | 29.9 | 285 | 305 | 20 | 2.7 | — | bright yellow |
| 3 (base oil) | 2078 | 37.1 | 375 | 455 | 80 | 7.1 | 0.878 | yellow |

-continued

| Fraction | Quantity | % | Head Temperature °C. | Sump Temperature °C. | Pressure mbar | Viscosity °E. (50° C.) | Density | Color |
|---|---|---|---|---|---|---|---|---|
| Sump | 409 | 7.3 | — | — | — | — | — | black |
| Water | 319 | 5.7 | — | — | — | — | — | — |
| Gaseous products | 297 | 5.3 | — | — | — | — | — | |
| Total | 5600 | 100 | | | | | | |

During distillation, the added KOH/NaOH mixture forms an emulsion in the oil, which encompasses and neutralizes the impurities (ash components etc.), having a cracking effect on the oil. This effect cannot be achieved with one of the two alkali metal hydroxides alone, which effect permits the exceedingly high distillation temperature.

EXAMPLE 5

2000 g. of dry oil (used oil I) are mixed in a distillation flask with 240 g. of 50% alkali hydroxide (ratio KOH/NaOH 3:7, corresponding to 1.8 weight % KOH, 4.2 weight % NaOH and 6 weight % water related to dry oil).

The mixture is heated to 360° C. under standard pressure and left at that temperature for 5 minutes, whereby the water and a part of the easily boiling hydrocarbons is distilled off.

After cooling to 150° C., the oil is decanted off the sludge, and mixed at a temperature of 45° C. with 30 g. sulfuric acid 98 weight % (corresponding to 1.5% sulfuric acid, related to dry oil).

The acid tar that forms is immediately deposited and is drawn off after 30 minutes.

The remaining acid oil is mixed with 80 g. of activated bleaching clay (corresponding to 4 % bleaching clay, related to dry oil), and is subjected in a distillation flask to a 30 minute hot contact bleach up to a temperature of 305° C.

Gas and spindle oil are distilled off in succession during the hot contact bleach. The remaining base oil is filtered clean via a pressure filter. Fraction 1 and 2 are filtered with 1% neutralization clay.

The following distribution of yield is achieved:

| Fraction | Quantity g | % | Distillation temperature Wall °C. | Distillation temperature Head °C. | Pressure mbar | Density g/cm³ | Viscosity °E. (50° C.) | Color |
|---|---|---|---|---|---|---|---|---|
| 1 (gas oil) | 320 | 13.6 | 225 | 250 | 20 | 0.85 | — | colorless |
| 2 (spindle oil) | 407 | 17.3 | 285 | 305 | 20 | — | 2.6 | bright yellow |
| 3 (base oil) | 747 | 31.7 | — | — | — | — | 7.6 | yellow |
| Sludge | 370 | 15.7 | — | — | — | — | — | black |
| Water | 144 | 6.1 | — | — | — | — | — | — |
| First runnings | 135 | 5.7 | — | — | — | — | — | — |
| Bleaching clay oiled | 174 | 7.4 | | | | | | |
| Acid tar | 60 | 2.5 | | | | | | |
| Total | 2.357 | 100 | | | | | | |

The treatment according to the invention, in case of a series connected acid treatment, will permit one to get along with an extremely low $H_2SO_4$ quantity; the acid tar yield is correspondingly low.

For the experiments according to the following two embodiments, a sodium metal dispersion of 1 part by weight of sodium metal and 2 parts by weight of spindle oil (viscosity at 50° C. between 2.0 and 3.0 °E) with a mean particle size of about 10 μm was used. It was produced above the melting point of the alkali metal in a heatable agitator with a dispersing apparatus according to the rotor-stator principle, running at high speed.

EXAMPLE 6

Continuous used oil treatment in an agitator vessel. (Na-metal/KOH treatment, sump separation prior to distillation)

In a heatable agitator container, a sufficient quantity of dried used oil 2 is heated to 105° C. and conveyed into an agitator vessel at a rate of 30 kg/hour in which it is mixed with 1.5 kg. of sodium dispersion per hour. The used oil thus mixed with 1.7% of sodium metal, with a residence time of about 5 minutes, is conveyed by way of two additional agitator vessels into a fourth agitator vessel, in which the sodium metal, which has not yet completely reacted, as well as the highly reactive sodium metal secondary products, are decomposed by addition of 1.64 kg. of 50% KOH per hour

| | |
|---|---|
| (corresponding to | 2.8 weight % of water |
| as well as | 2.8 weight % of KOH 100%) |

The oil which was heated by the treatment to about 140° C., runs from the decomposition vessel into a supply tank.

10 kg. of the oil treated thus are heated to 360° C. under standard pressure and are left at this temperature for 5 minutes, whereby the water and a small quantity of low boiling hydrocarbons distills off.

After cooling to 150° C., the supernatant oil may easily be decanted; the remaining sludge is separated and weighed.

The oil is subsequently fractionated in a film evaporator with a surface of 0.05 m². For this purpose, it is put into the evaporator three times in succession at a dosing-in speed of 1.1 kg/hour at different wall temperatures and different pressures, the rotor of said evaporator running at about 600 r.p.m.

Treatment and distillation produce the following results:

| Fraction | Quantity g | Distillation temperature Wall °C. | Head °C. | Pressure mbar | Density g/cm³ | Viscosity °E. (50° C.) | Color |
|---|---|---|---|---|---|---|---|
| 1 (Gas oil) | 1350 | 210 | 175 | 5 | 0.859 | — | colorless |
| 2 (Spindle oil) | 1600 | 290 | 225 | 5 | — | 2.4 | bright yellow |
| 3 (base oil) | 4000 | 350 | 280 | 1.5 | 0.88 | 5.5 | bright yellow |
| Sludge after decanting | 1370 | — | — | — | — | — | black |
| Sump of | 520 | — | — | — | — | — | black |
| Water | 300 | — | — | — | — | — | — |
| First runnings | 860 | — | — | — | — | — | — |
| Total | 10.000 | | | | | | |

| Analytical values fraction 3 | Unit | Regulation | Values |
|---|---|---|---|
| Viscosity at −17.8° C. | m Pa.s | DIN 51377 | 7300 |
| Viscosity at 40.0° C. | $m^2/s^+$ | DIN 51562 | $67.72.10^{-6}$ |
| Viscosity at 100.0° C. | $m^2/s^+$ | DIN 51561 | $8.39.10^{-6}$ |
| Density at 15° C. | g/ml | DIN 51757 | 0.886 |
| Flashpoint acc. to Cleveland | °C. | DIN 51376 | 252 |
| Setting point | °C. | DIN 51583 | −12 |
| Viscosity index/VI | — | DIN 51564 | 92 |
| Sulfur content | weight % | DIN 51768 | 0.61 |
| Sulfate ash | weight % | DIN 51575 | 0.00 |
| Coke residue acc. to Conradson | weight % | DIN 515551 | 0.04 |
| Loss from evaporation | weight % | DIN 51581 | 7.9 |
| Corrosion effect on copper | note | DIN 51579 | 1 |

+kinematic viscosity

The base oil thus corresponds to the requirements which are set for a high quality lubricating oil.

EXAMPLE 7

5,000 g. of dried used oil (used oil I from Example 1) are treated at 150° C. under a nitrogen atmosphere with 1.6% of sodium metal (as a 33% dispersion in spindle oil). The reaction is stopped after 5 minutes with 280 g. of 50% KOH (corresponding to 2.8 weight % $H_2O$ and 2.8 weight % KOH 100%).

The oil, treated thus is heated under standard pressure to 360° C., and is left at this temperature for 5 minutes, whereby the water and a small quantity of low boiling hydrocarbons are distilled off and the oil is then subjected to a vacuum distillation, without previous separation of sludge. The following fractions are obtained:

| Fraction | Quantity g | % | Head temperature °C. | Sump (max.) °C. | Pressure mbar | Viscosity °E. (50° C.) | Density | Color |
|---|---|---|---|---|---|---|---|---|
| 1 (Gas oil) | 865 | 15.7 | 225 | 250 | 20 | — | 0.849 | colorless |
| 2 (Spindle oil) | 1545 | 28.0 | 285 | 305 | 20 | 2.8 | — | bright yellow |
| 3 (Base oil) | 2105 | 38.1 | 370 | 450 | 80 | 7.0 | — | bright yellow |
| Sump | 415 | 7.5 | — | — | — | — | — | black |
| Water | 305 | 5.5 | — | — | — | — | — | — |
| gaseous Products | 285 | 5.2 | | | | | | |
| Total | 5520 | 100 | | | | | | |

During the distillation, the added KOH/NaOH mixture forms an emulsion in the oil, which surrounds and neutralizes the impurities (ash-components etc.) having a cracking effect on the oil. This effect cannot be achieved with one of the two alkali metal hydroxides alone, which permits the extra ordinarily high distillation temperature.

EXAMPLE 8

Coking of sludge, obtained in case of decanting, and of distillation sump.

1000 g. of a starting product (from the combined sludge and distillation sump from example 6) were coked in a steel retort. The filled retort is placed in a pre-heated oven, so that the temperature in the middle of the sump will reach 600° C. after 4 hours. Subsequently, the sump is left at this temperature for 30 minutes. Aromatics and tar oil are condensed, the gas portion is collected in a gas-collecting container.

The coking produces the following results:

| | Quantity | | Weight % |
|---|---|---|---|
| Gas | 29 | Nl. | 2.9 |
| Water | 7 | g. | 0.7 |
| Aromatics (boiling point) <150° C. | 28 | g. | 2.8 |
| Tar oil | 448 | g. | 44.8 |
| Coke | 488 | g. | 48.8 |

EXAMPLE 8

Gas Composition

| | | | |
|---|---|---|---|
| (a) qualitative | | | |
| hydrogen | | propane | |
| nitrogen | | iso-butane | |
| methane | | iso-butane | |
| carbon dioxide | | n-butane | |
| ethylene | | 2,2 dimethyl propane | |
| ethane | | iso-pentane | |
| propylene | | n-pentane | |
| (b) quantitative | | | |
| $CO_2$ | volume % | 12.4 | |
| alkene | volume % | 14.4 | |
| CO | volume % | 4.8 | |
| $H_2$ | volume % | 31.7 | |
| $CH_4$ | volume % | 13.6 | |
| $C_2$ + higher hydrocarbons | volume % | 11.1 | |
| nitrogen | volume % | 12.0 | |
| standard density | $kg/m^3$ | 1.00 | |
| fuel value (standard cond.) | $kJ/m^3$ | 29950 | |
| heat value (standard cond.) | $kJ/m^3$ | 27300 | |

EXAMPLE 8

Analytical data

| | | | |
|---|---|---|---|
| Petrol Coke | | | |
| ash at 815° C. | | % | 85.5 |
| sulfur | | | 2.4 |
| halogens (as Cl) | | | 3.1 |
| free alkali | | | 6.25 mV/g |
| Coke Ash | | | |
| silicon | | % | 0.56 |
| iron | | | 1.38 |
| aluminum | | | 0.22 |
| calcium | | | 1.48 |
| magnesium | | | 0.60 |
| sodium | | | 21.3 |
| potassium | | | 25.8 |
| copper | | | 0.04 |
| chromium | | | 0.04 |
| lead | | | 1.56 |
| nickel | | | 0.09 |
| zinc | | | 0.52 |
| Tar Oil | | | |
| Analysis of elements | | | |
| C | % | | 85.73 |
| H | % | | 12.72 |
| N | % | | 0.35 |
| Cl | % | < | 0.05 |
| S | % | | 0.96 |

EXAMPLE 8

Course of boiling

| Temp. | Pressure | % |
|---|---|---|
| 225° C. | 20 mbar | 29.3 |
| 285° C. | 20 mbar | 47.8 |
| 325° C. | 1.5 mbar | 90.0 |

EXAMPLE 9

Treatment of tar oil 200 g. of tar oil (see example 8) are treated at 150° C. under a nitrogen atmosphere with 1.6% of sodium metal (as a 33% dispersion in spindle oil). The reaction is stopped after 5 minutes with 11.6 g. of 50% KOH (corresponding to 2.8 weight % $H_2O$ and 2.8 weight % of KOH 100%).

The tar oil treated thus is heated to 360° C. at standard pressure and is left at this temperature for 5 minutes, whereby the water and a small quantity of low boiling hydrocarbons distills off. Subsequently, the oil is subjected to a vacuum distillation in a distillation flask. The following fractions are obtained:

| Fraction | Quantity g | % | Head temperature °C. | Sump (max.) °C. | Pressure mbar | Viscosity °E. (50° C.) | Density | Color |
|---|---|---|---|---|---|---|---|---|
| 1 (gas oil) | 51 | 23.2 | 225 | 250 | 20 | — | 0.85 | bright yellow |
| 2 (spindle oil) | 33 | 15.0 | 285 | 305 | 20 | 2.8 | — | bright yellow |
| 3 (base oil) | 77 | 35.0 | 305 | 335 | 20 | 5.8 | | yellow |
| sump | 53 | 24.1 | — | — | — | — | — | black |
| water | 6 | 2.7 | — | — | — | — | — | — |
| total | 220 | 100 | | | | | | |

Further modifications and variations will be apparent to those skilled in the art and are intended to be encompassed by the appended claims.

We claim:

1. In a process for the refining of used lubricating oils by alkaline treatment of the oil or of its crude raffinate at a temperature from 200° to 500° C. as well as further reprocessing, the improvement wherein the oil is treated with 0.5 to 10% by weight of an alkali metal hydroxide mixture of 20 to 70 parts by weight of potassium hydroxide and 30 to 80 parts by weight of sodium hydroxide, said mixture of alkali metal hydroxide is used in a concentrated solution of at least 20% by weight of solid substance content and the alkaline treatment, following a crude refining of the dried oil with finely dispersed metallic sodium, is accomplished, whereby the potassium hydroxide—sodium hydroxide mixture is produced by the addition of aqueous or alcoholic KOH-solution to the oil containing residual metallic sodium.

2. In a process for the refining of used lubricating oils by alkaline treatment of the oil or of its crude raffinate at a temperature from 200° to 500° C. as well as further reprocessing, the improvement wherein the oil is treated with 0.5 to 10% by weight of an alkali metal hydroxide mixture of 20 to 70 parts by weight of potassium hydroxide and 30 to 80 parts by weight of sodium hydroxide, said mixture of the alkali metal hydroxide is used in a concentrated solution of at least 20% by weight of solid substance content and the oil is separated after the alkaline treatment by decanting and is reprocessed by distillation, said alkaline treatment being accomplished after a reaction with finely dispersed metallic sodium, whereby the alkali metal hydroxide mixture is produced by the addition of aqueous or alcoholic KOH solution to the oil containing residual metallic sodium.

3. In a process for the refining of used lubricating oils by alkaline treatment of the oil or of its crude raffinate at a temperature from 200° to 500° C. as well as further reprocessing, the improvement wherein the oil is treated with 0.5 to 10% by weight of an alkali metal hydroxide mixture of 20 to 70 parts by weight of potassium hydroxide and 30 to 80 parts by weight of sodium hydroxide, whereby a sludge is formed and deposited as a result of the treatment of the oil with the alkali metal hydroxide mixture, said sludge is then separated and the supernatant treatment product thereby obtained is subjected to a solvent extraction with concentrated sulfuric acid and subsequent bleaching clay filtration, wherein the mixture of alkali metal hydroxide is used in a concentrated solution of at least 20% by weight of solid substance content and the alkaline treatment, following a crude refining of the dried oil with finely dispersed metallic sodium, is accomplished, whereby the potassium hydroxide—sodium hydroxide mixture is produced by the addition of aqueous or alcoholic KOH solution to the oil containing residual metallic sodium.

4. In a process for the refining of used lubricating oils by alkaline treatment of the oil or of its crude raffinate at a temperature from 200° to 500° C. as well as further reprocessing, the improvement wherein the oil is treated with 0.5 to 10% by weight of an alkali metal hydroxide mixture of 20 to 70 parts by weight of potassium hydroxide and 30 to 80 parts by weight of sodium hydroxide, wherein the alkali metal hydroxide mixture is added to the oil and a distillation is accomplished in the presence of said mixture.

5. In a process for the refining of used lubricating oils by alkaline treatment of the oil or of its crude raffinate at a temperature from 200° to 500° C. as well as further reprocessing, the improvement wherein the oil is treated with 0.5 to 10% by weight of an alkali metal hydroxide mixture of 20 to 70 parts by weight of potassium hydroxide and 30 to 80 parts by weight of sodium hydroxide, said alkali metal hydroxide mixture is added to the oil and a distillation is accomplished in the presence of said mixture and further, wherein the mixture of alkali metal hydroxide is used in a concentrated solution of at least 20% by weight of solid substance content and the alkaline treatment, following a crude refining of the dried oil with finely dispersed metallic sodium, is accomplished, wherein the potassium hydroxide—sodium hydroxide mixture is produced by the addition of aqueous or alcoholic KOH-solution to the oil containing residual metallic sodium.

* * * * *